US010017231B2

(12) United States Patent
Fawcett, Jr.

(10) Patent No.: US 10,017,231 B2
(45) Date of Patent: Jul. 10, 2018

(54) INDICATOR FOR MANUAL INFLATOR

(71) Applicant: Halkey-Roberts Corporation, St. Petersburg, FL (US)

(72) Inventor: Lyman W. Fawcett, Jr., St. Petersburg, FL (US)

(73) Assignee: Halkey-Roberts Corporation, St. Petersburg, FL (US)

( * ) Notice: Subject to any disclaimer, the term of this patent is extended or adjusted under 35 U.S.C. 154(b) by 121 days.

(21) Appl. No.: 15/078,693

(22) Filed: Mar. 23, 2016

(65) Prior Publication Data

US 2016/0280342 A1 Sep. 29, 2016

Related U.S. Application Data

(60) Provisional application No. 62/136,684, filed on Mar. 23, 2015.

(51) Int. Cl.
*B63C 9/18* (2006.01)
*B63C 9/20* (2006.01)

(52) U.S. Cl.
CPC . *B63C 9/18* (2013.01); *B63C 9/20* (2013.01)

(58) Field of Classification Search
CPC ..... B63C 9/18; B63C 9/20
USPC ..... 116/200, 209, 210, 278, DIG. 7–DIG. 9; 141/19; 441/89–94; 250/526; 222/5; 137/223
See application file for complete search history.

(56) References Cited

U.S. PATENT DOCUMENTS 3,059,814 A 10/1962 Poncel et al.
3,091,782 A 6/1963 Sclafani, Jr.
3,426,942 A 2/1969 McMains et al.
3,579,964 A 5/1971 Ohlstein
3,702,014 A 11/1972 Rabon et al.
3,746,285 A * 7/1973 Mango ..... B64B 1/62 116/210
3,754,731 A 8/1973 Mackal
3,757,371 A 9/1973 Martin
3,809,288 A 5/1974 Mackal
3,910,457 A 10/1975 Sutliff et al.
3,997,079 A 12/1976 Niemann
4,216,182 A 8/1980 Mackal
4,223,805 A * 9/1980 Mackal ..... B63C 9/18 222/5
4,260,075 A 4/1981 Mackal
4,267,944 A 5/1981 Mackal
4,382,231 A 5/1983 Miller
4,416,393 A * 11/1983 Zimmerly ..... B63C 9/24 222/153.14
4,436,159 A 3/1984 Revay
4,482,333 A * 11/1984 Geri ..... B63C 9/23 340/539.1
4,513,248 A 4/1985 Miller
4,627,823 A 12/1986 Mackal
4,894,036 A * 1/1990 Switlik ..... B63C 9/24 441/93

(Continued)

*Primary Examiner* — R. A. Smith
*Assistant Examiner* — Tania Courson
(74) *Attorney, Agent, or Firm* — GrayRobinson, P.A.

(57) ABSTRACT

An indicator to be snapped onto an inflator to indicate the "ready" operating condition of the inflator and, upon firing of the inflator by jerking the jerk handle to pivot the firing lever, the firing lever pops off the indicator from the inflator, thereby indicating the "fired" inoperable operating condition.

17 Claims, 16 Drawing Sheets

(56) References Cited

U.S. PATENT DOCUMENTS 5,026,310 A 6/1991 Mackal et al.
5,058,932 A 10/1991 Mackal
5,058,933 A 10/1991 Mackal
5,076,468 A 12/1991 Mackal
5,080,402 A 1/1992 Mackal
5,271,525 A * 12/1993 Petrie ..... B63C 9/24 222/5
5,333,656 A * 8/1994 Mackal ..... B63C 9/24 141/19
5,400,922 A 3/1995 Weinheimer et al.
5,509,576 A 4/1996 Weinheimer et al.
5,564,478 A * 10/1996 Weinheimer ..... B63C 9/24 141/19
5,601,124 A 2/1997 Weinheimer et al.
5,643,030 A * 7/1997 Brown ..... B63C 9/24 116/277
5,694,986 A * 12/1997 Weinheimer ..... B63C 9/24 141/19
5,775,358 A 7/1998 Fawcett, Jr. et al.
6,422,420 B1 * 7/2002 Brown ..... B63C 9/24 116/277
6,589,087 B2 7/2003 Mackal
7,056,179 B2 * 6/2006 Courtney ..... B63C 9/0005 441/90
7,475,111 B2 1/2009 Bent et al.
7,475,711 B2 * 1/2009 Fawcett, Jr. ..... B63C 9/24 141/19
7,854,347 B2 * 12/2010 Wang ..... B63C 9/24 141/329
7,861,373 B2 * 1/2011 Fawcett, Jr. ..... F16G 11/101 123/185.2
8,353,736 B2 * 1/2013 Wang ..... F04B 33/005 102/530
8,360,276 B2 1/2013 Rogier et al.
2004/0157514 A1 * 8/2004 Courtney ..... B63C 9/081 441/88
2007/0277903 A1 12/2007 Fawcett

* cited by examiner

INDICATOR FOR MANUAL INFLATOR

CROSS-REFERENCE TO RELATED APPLICATIONS

This application claims the benefit of provisional application, Ser. No. 62/136,684, filed Mar. 23, 2015, the disclosure of which is hereby incorporated by reference herein.

BACKGROUND OF THE INVENTION

Field of the Invention

This invention relates to an inflator for inflating articles such as personal floatation devices, rafts, buoys, and emergency signaling equipment. More particularly, this invention relates safety indicators for inflators to indicate when the inflator has been previously fired and is no longer operable to inflate the inflatable article.

Description of the Background Art

Presently, there exist many types of inflators designed to inflate inflatable articles such as personal floatation devices (life vests, rings and horseshoes), life rafts, buoys and emergency signaling equipment. Inflators typically comprise a body for receiving the neck of a cartridge of compressed gas such as carbon dioxide. A reciprocating pierce pin is disposed within the body of the inflator for piercing the frangible seal of the cartridge to permit compressed gas therein to flow into the article to be inflated. Typically, a manually movable firing lever is operatively connected to the piercing pin such that the piercing pin pierces the frangible seal of the cartridge upon jerking of a ball/jerk lanyard. U.S. Pat. Nos. 5,080,402, 5,058,933, 5,058,932, 4,216,182, 3,809,288, 3,754,731, and 3,809,288, the disclosure of each of which are hereby incorporated by reference herein, illustrates one particular embodiment of a manual inflator that utilizes an inflation manifold that connects to the inflatable article allowing, upon firing, gas from the gas cartridge to flow through the inflator then through the manifold into the inflatable article. U.S. Pat. Nos. 7,475,711, 5,564,478 and 4,894,036, the disclosures of each of which are incorporated by reference herein, illustrate other embodiments of manual inflators that are heat-sealed directly to the inflatable article, thereby eliminating the need for an inflation manifold.

Water-activated actuators have been incorporated into manual inflators so that in an emergency situation such as downed aviator, injured person or a man overboard, the inflator is automatically actuated to inflate the inflatable article to which it is connected. Representative automatic actuators for inflators are disclosed in U.S. Pat. Nos. 3,059,814, 3,091,782, 3,426,942, 3,579,964, 3,702,014, 3,757,371, 3,910,457, 3,997,079, 4,223,805, 4,267,944, 4,260,075, 4,382,231, 4,436,159, 4,513,248, 4,627,823, 5,5026,310, 5,076,468, 5,400,922, 5,509,576, and 5,601,124, the disclosures of each of which are hereby incorporated by reference herein.

Status indicators or guards have been developed for inflators to indicate their operating condition such as whether they are in "ready" condition for firing or are inoperable due to a previously-fired or missing gas cartridge or to guard against inadvertent firing. U.S. Pat. Nos. 4,416,393, 5,694,986, 5,775,358, 6,589,087, 8,360,276 illustrate various types of indicators/guards for inflators to indicate their operating condition. U.S. Pat. Nos. 7,475,711 and 5,564,478 teach a safety/indicator clip, typically colored green, for retaining the firing lever of heat-sealable inflators into its normal unfired position substantially flush with the side of the inflator such that the firing lever does not protrude therefrom and otherwise be inadvertently caught or snagged. U.S. Pat. No. 7,475,711 further provides that upon firing by jerking the handle, the firing lever pivots away to pop-off the safety clip to expose a red-colored flag indicating that the gas cartridge has been fired.

The safety clips of U.S. Pat. Nos. 7,475,711 and 5,564,478 have been widely accepted in the industry to indicate the firing status of the inflator. However, such safety clips are small and are narrowly viewable from one direction to indicate the firing condition or status of the inflator. Accordingly, there presently exists a need for a more visible status indicator that may be viewed from all angles.

Therefore, it is an object of this invention to provide an improvement which overcomes the aforementioned inadequacies of the prior art devices and provides an improvement which is a significant contribution to the advancement of the inflation art.

Another object of this invention is to provide a pop-off indicator for inflators to indicate a previously-fired condition of the inflator.

Another object of this invention is to provide a status indicator for inflators that is visible when viewed from all angles.

Another object of this invention is to provide a status indicator, preferably colored green, that fully covers the firing lever, preferably colored red, such that in the at-ready "green" condition the green status indicator conceals the red firing lever and readily viewable to indicate a "go" or "green" firing condition and such that after firing to pop-off the green status indictor revealing the red firing lever, the inoperable "no-go" or "red" condition is then readily viewable.

Another object of this invention is to provide a pop-off indicator for manual inflators such as those shown in U.S. Pat. Nos. 7,475,711 and 5,564,478 that are heat-sealed to the article to be inflated.

The foregoing has outlined some of the pertinent objects of the invention. These objects should be construed to merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises an indicator for inflators for indicating whether the inflator has been previously fired. More particularly, the invention comprises an indicator, preferably colored green to indicate a "ready" condition, that is dimensioned and configured to fit onto the housing of the inflator and wrap around and conceal the firing lever, preferably colored red. Upon pulling of the jerk handle to fire the inflator, the firing lever pivots outwardly and causes the indicator to be popped off the housing, thereby revealing the red-colored firing lever to indicate that the inflator has been fired.

The indicator may be held into position on the inflator's house by means of a fracturable bridge that breaks-away upon firing of the inflator. The fracturable bridge is intended to encumber the attempted re-use of the spent indicator after having been once used.

Alternatively or in addition to the fracturable bridge, the indicator may be molded in a contracted configuration so that when fitted onto the inflator's housing, it is spread apart or expanded and then simply snap fitted onto the inflator's housing and held in position more rigidly due to the inherent resiliency of the material constituting the indicator.

In either embodiments, tabs emanating from the inside surface of the indicator are provided to engage into corresponding gaps or slots in the inflator so as to provide a more secure engagement about the housing when snap-fitted thereto.

Notably, the status indicator of the invention is readily visible when viewed from all angles. Further, the green-colored status indicator fully covers the red-colored firing lever such that in the at-ready "green" condition the green status indicator conceals the red firing lever and is readily viewable to indicate a "go" or "green" firing condition. After firing by jerking on the firing lever, the indicator is popped-off re reveal the red firing lever, thereby indicating a readily viewable, inoperable "no-go" or "red" condition.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

FIG. 4 is a front view of the indicator;

Similar reference characters refer to similar parts throughout the several views of the drawings.

DETAILED DESCRIPTION OF THE PREFERRED EMBODIMENT

Figure 1A:
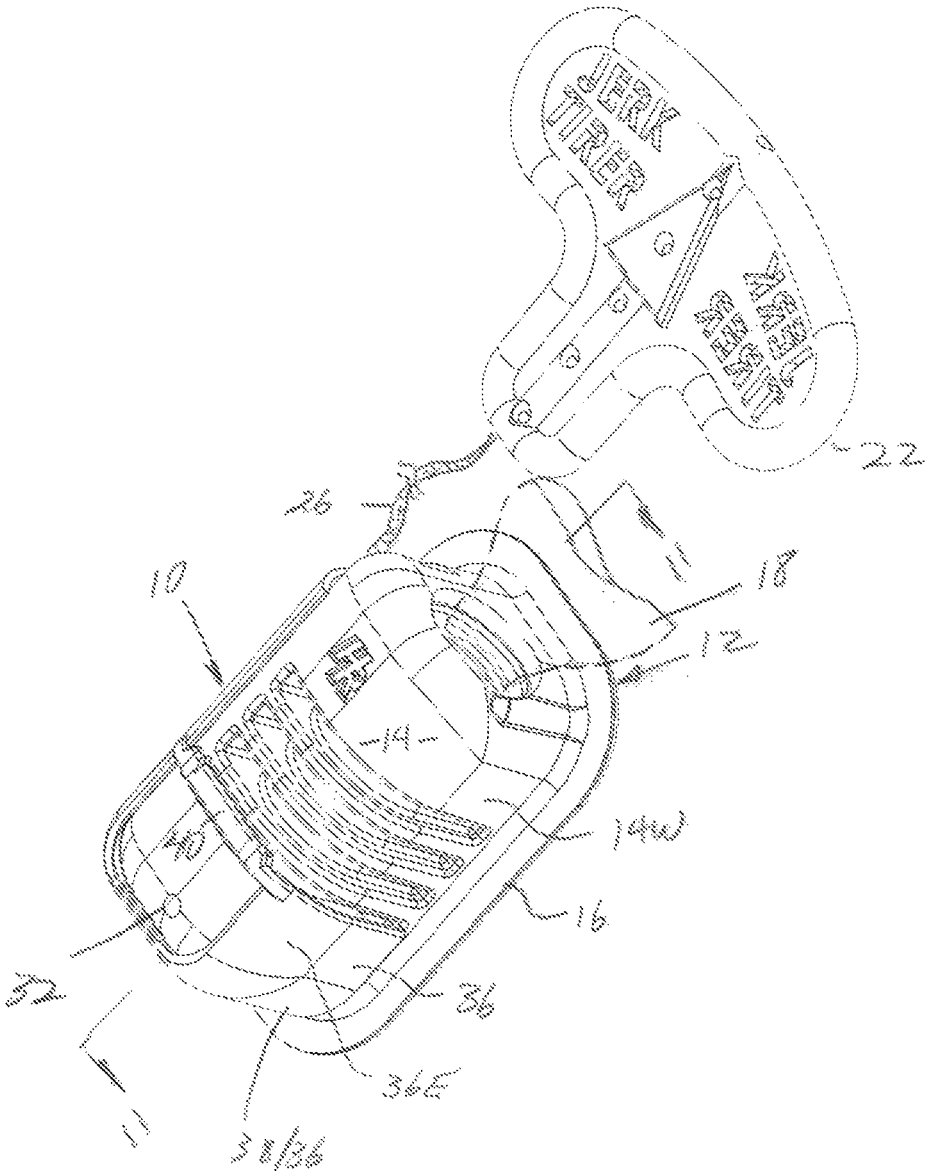
FIGS. 1A, 1B and 1C are top right perspective views showing (A) the indicator fitted onto the prior art inflator, (B) the prior art inflator without the indicator installed and (C) the indicator alone, not installed onto the prior art inflator.
Figure 1B:
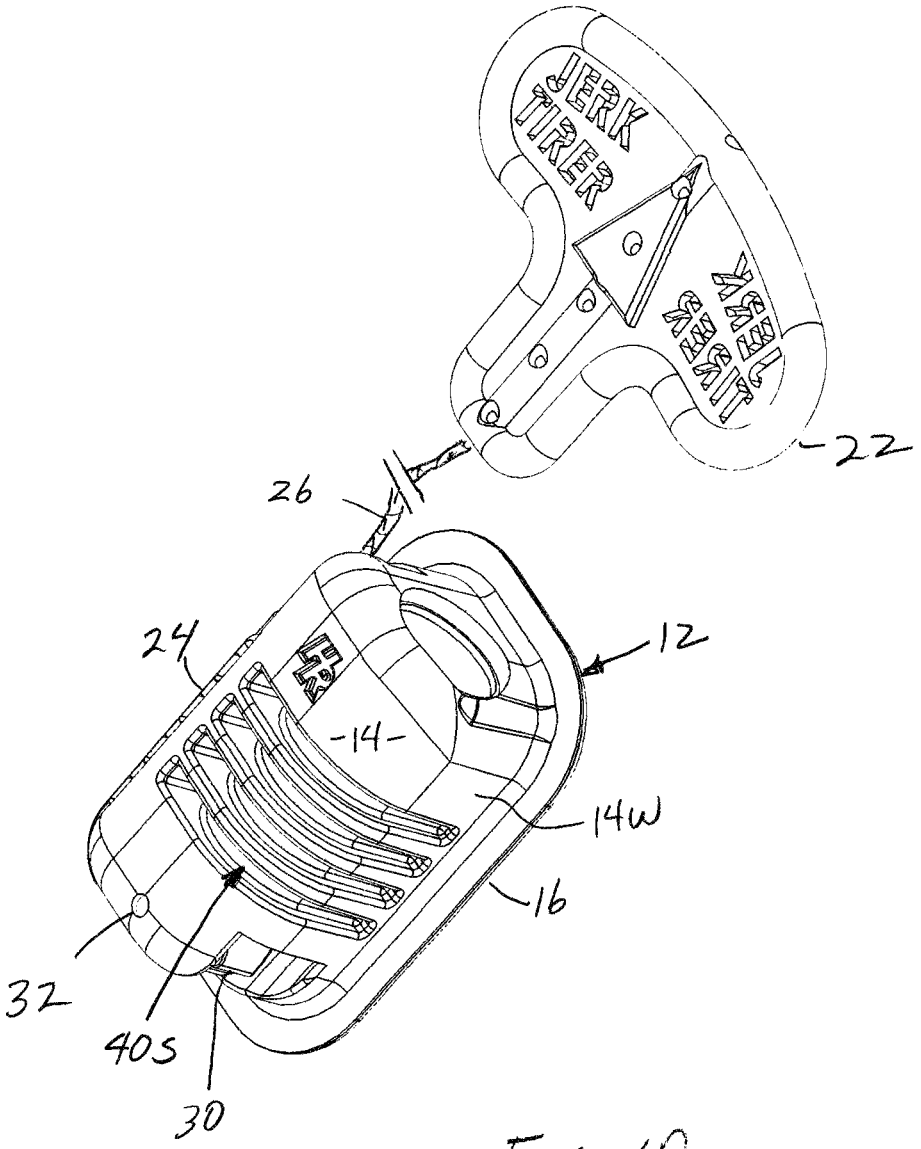
FIG. 1B PRIOR ART
Figure 1C:
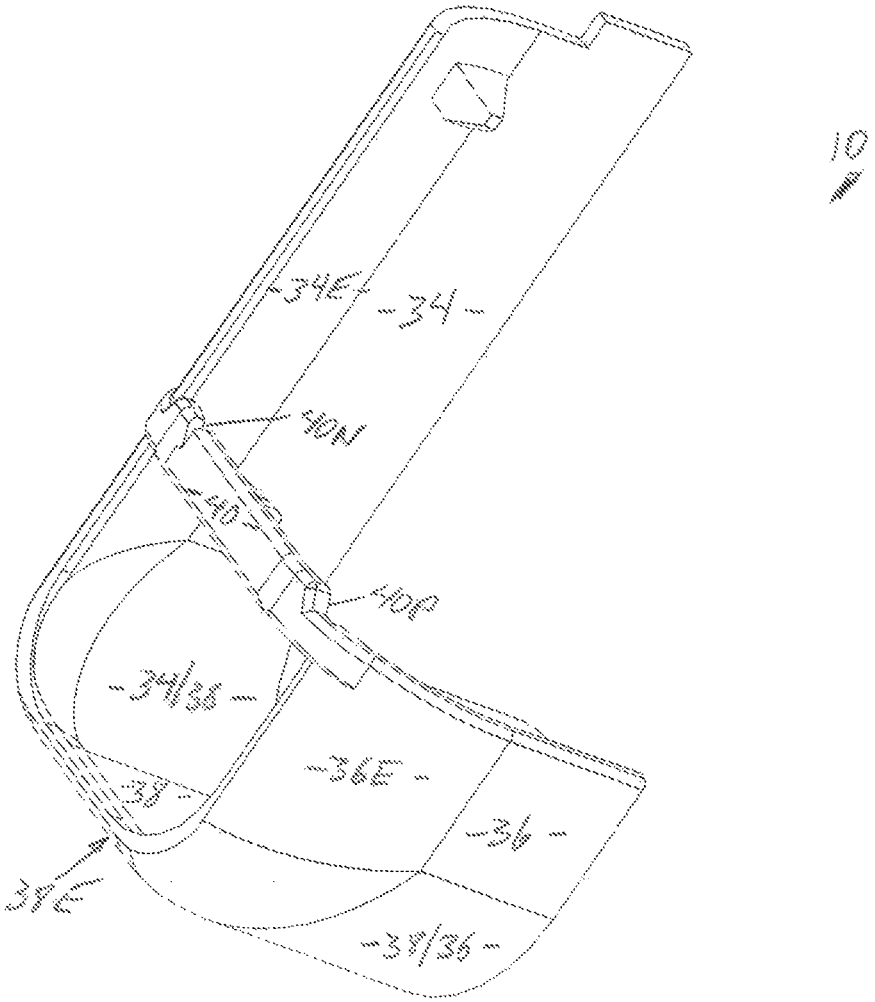

The indicator 10 of the invention is intended to be snapped onto an inflator 12 to indicate the "ready" operating condition of the inflator 12. Upon firing by jerking the jerk handle 22 to pivot the firing lever 24, the firing lever 24 pops off the indicator 10 from the inflator 12, thereby indicating the "fired" inoperable operating condition.

Inflators 12 come in a variety of shapes and sizes. It shall be understood, however, that the indicator 10 of the invention may be appropriately configured and dimensioned to fit a specific style of inflator 12. Accordingly, for the purpose of this detailed description of the indicator 10 of the invention, exemplary reference is made to the heat-sealable inflator 12 disclosed in U.S. Pat. No. 7,475,711, the disclosure of which is hereby incorporated by reference herein, which includes a generally rectangular housing 14. The indicator 10 is accordingly configured and dimensioned to fit about the generally rectangular housing 14 of such an inflator 12.

Figure 3:
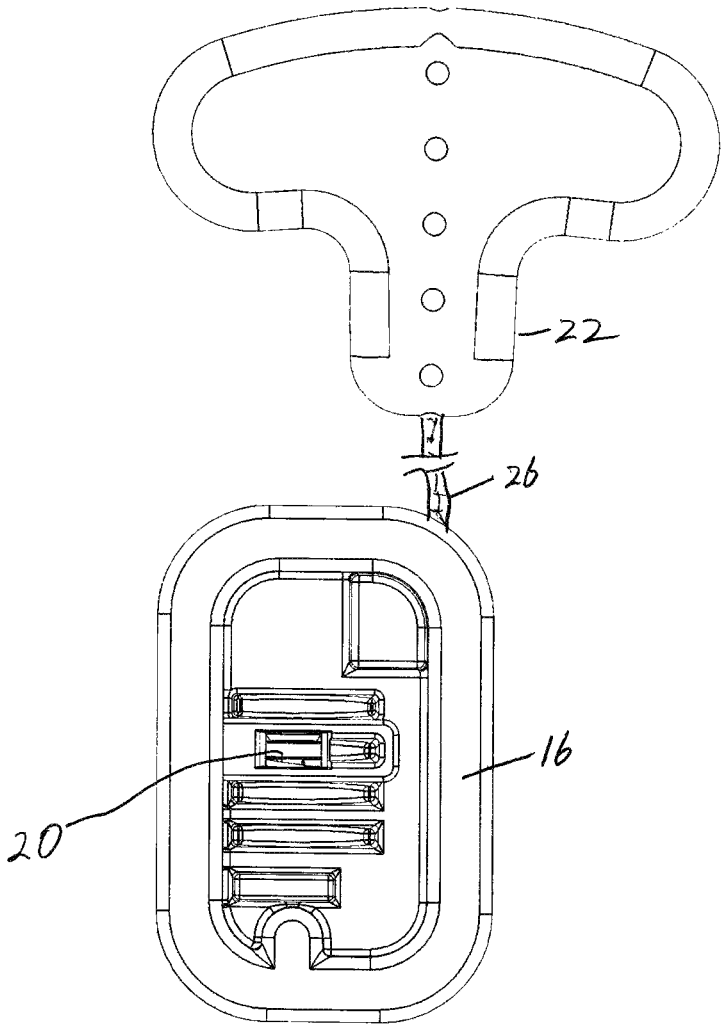
FIG. 3 PRIOR ART
FIG. 3 is a back view of the prior art inflator showing the exhaust port.
Figure 9:
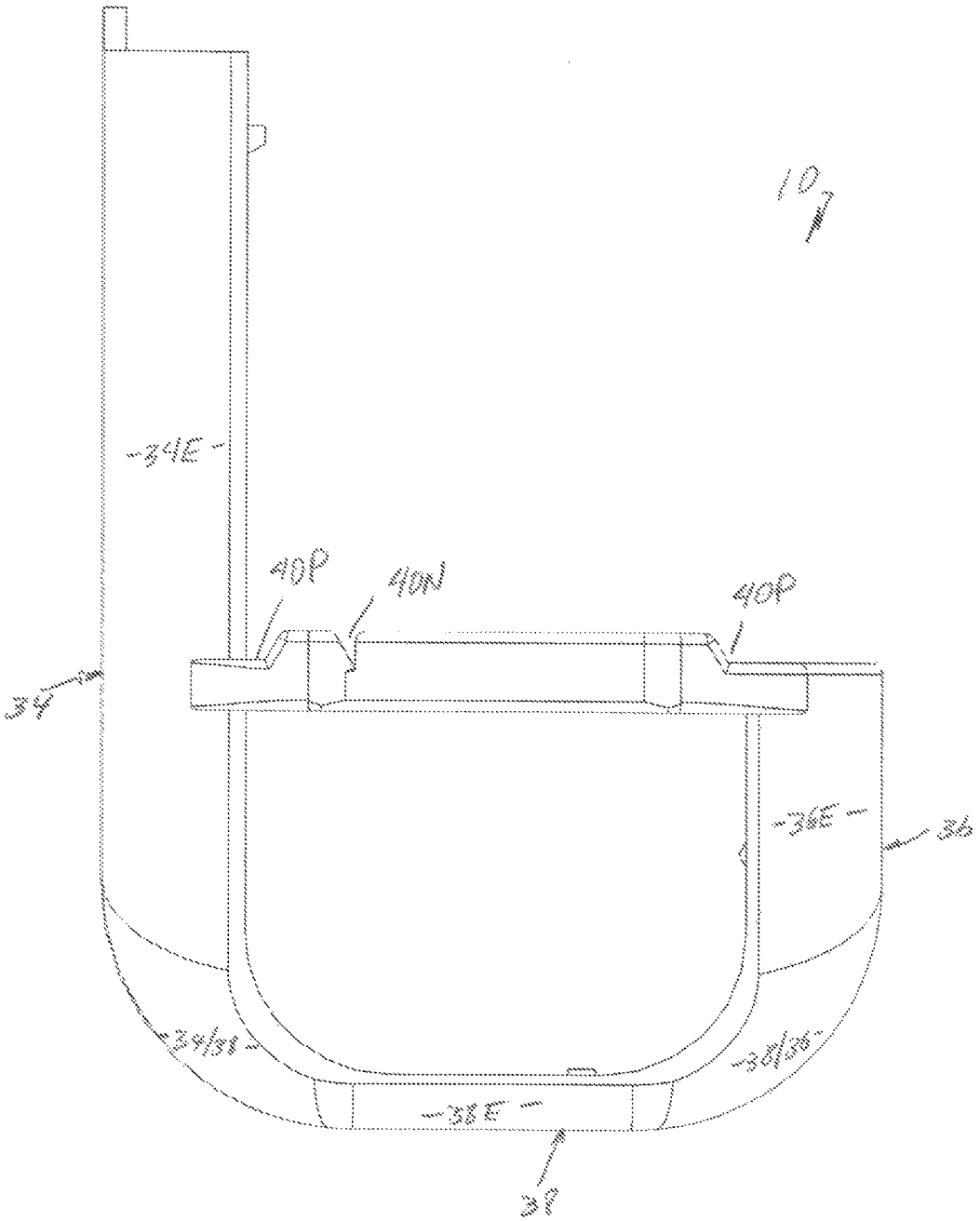
FIG. 9 is a rear view of the indicator.
Figure 5:
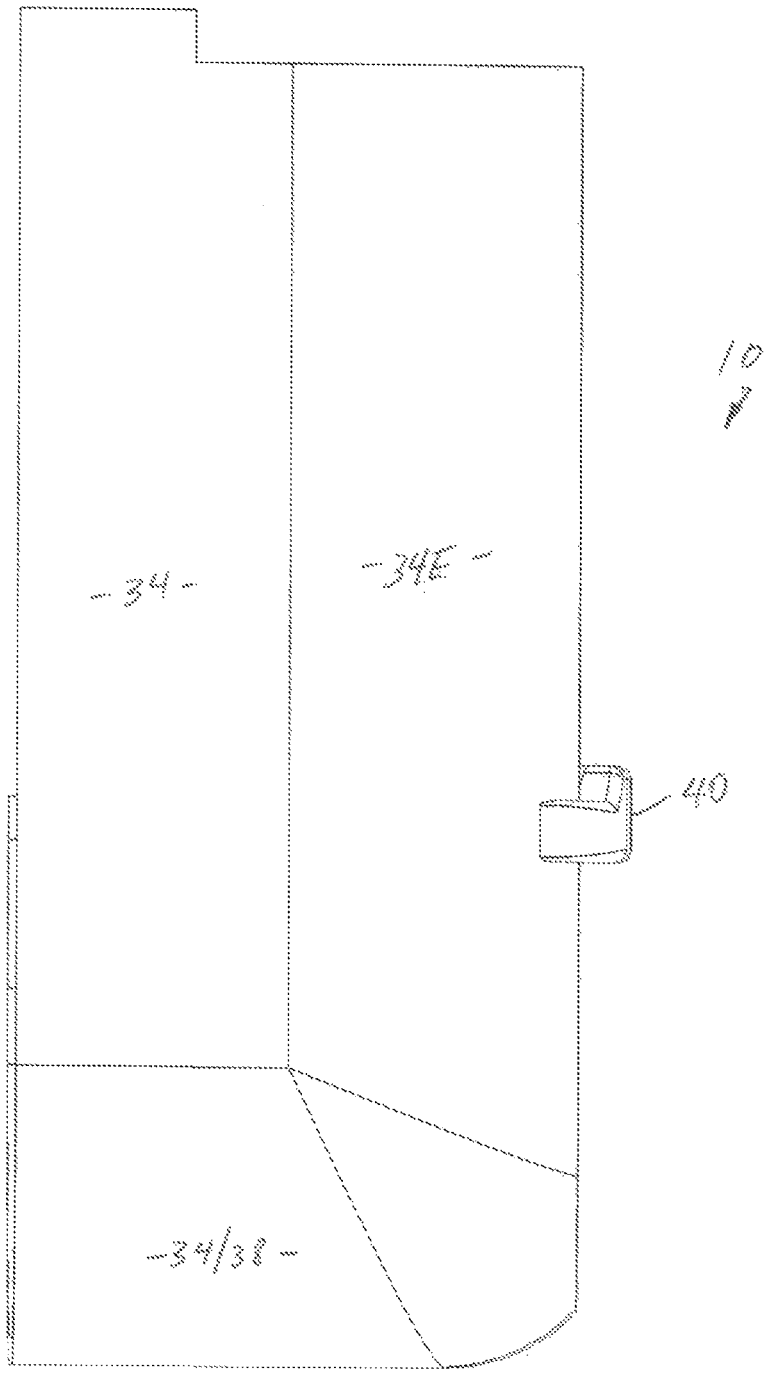
FIG. 5 is left side view of the indicator.
Figure 6:
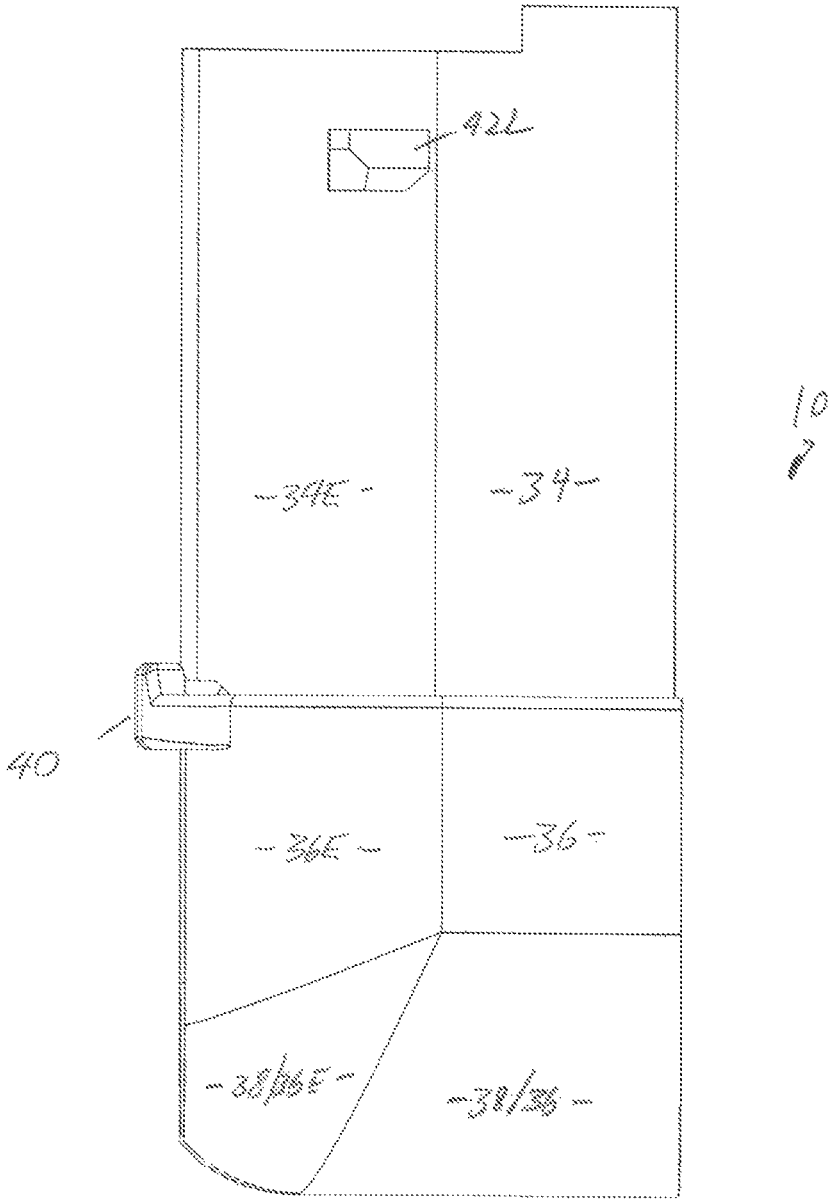
FIG. 6 is a right side view of the indicator.
Figure 7:
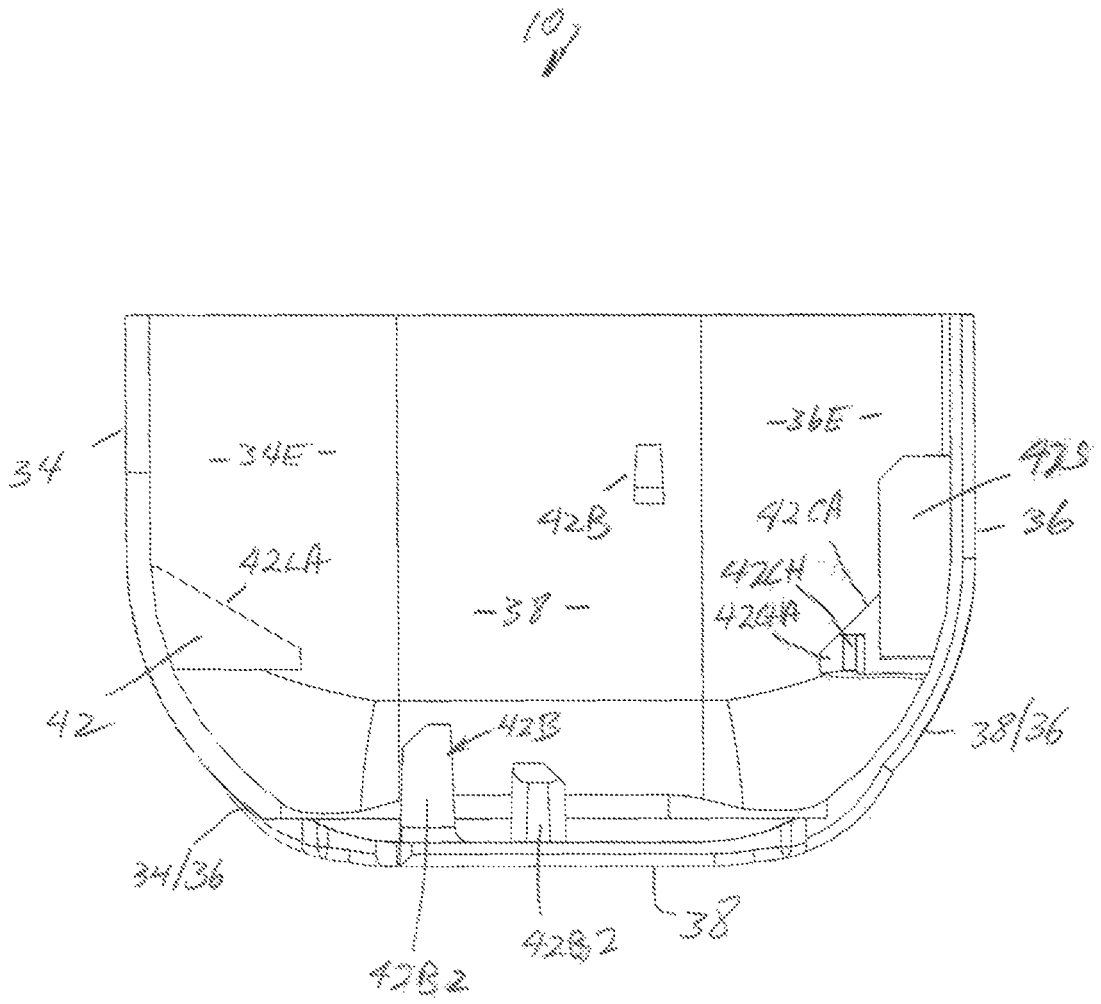
FIG. 7 is top side view of the indicator.
Figure 8:
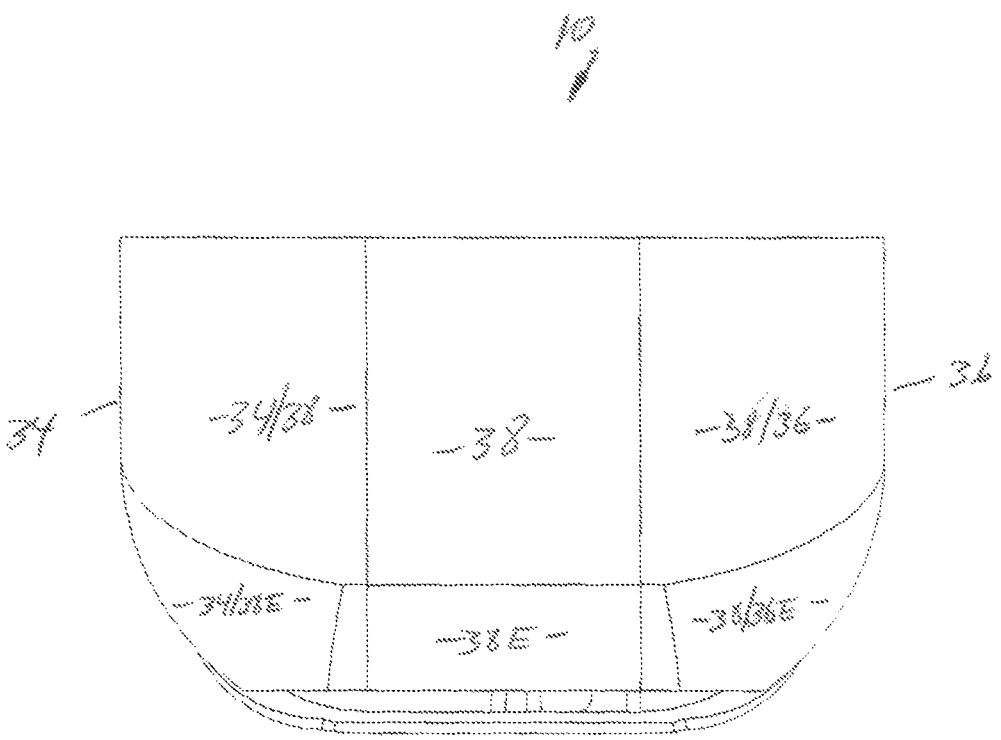
FIG. 8 is a bottom view of the indicator.
Figure 9:
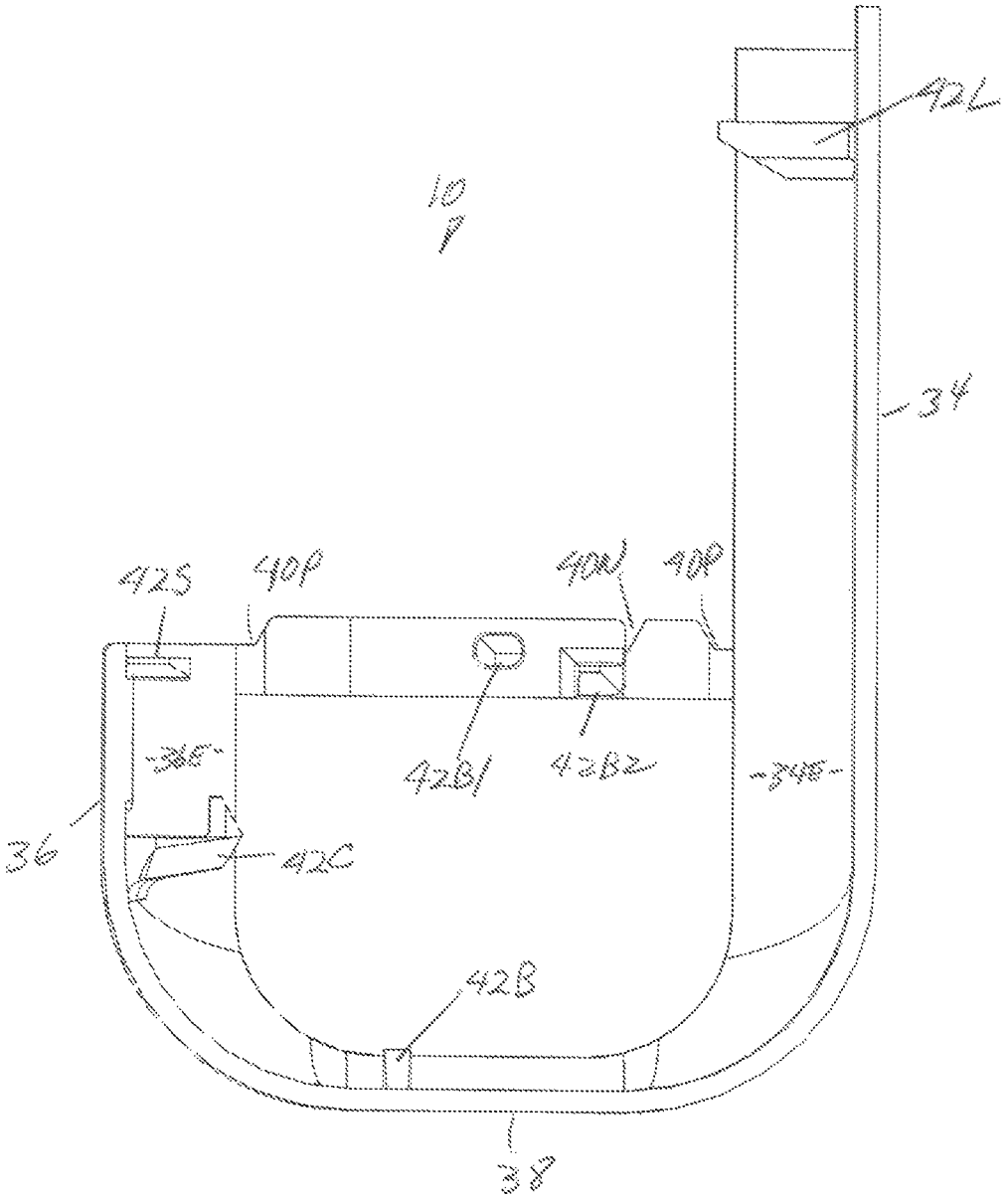

More particularly, heat-sealable inflators 12 typically comprise a generally rectangular housing 14 with side walls 14W and having an integral peripheral flange 16 composed of a heat-sealable material such as polyurethane that may be heat-sealed to the inflatable article such as personal floatation devices, life rafts, and the like (not shown.) The inflator 12 is adapted to receive the threaded neck of a gas cylinder (shown in phantom in FIG. 1A as numeral 18) such that upon firing, gas from the gas cartridge 18 may flow through the inflator 12 and out its exhaust port 20 (see FIG. 3) into the inflatable article.

Figure 2A:
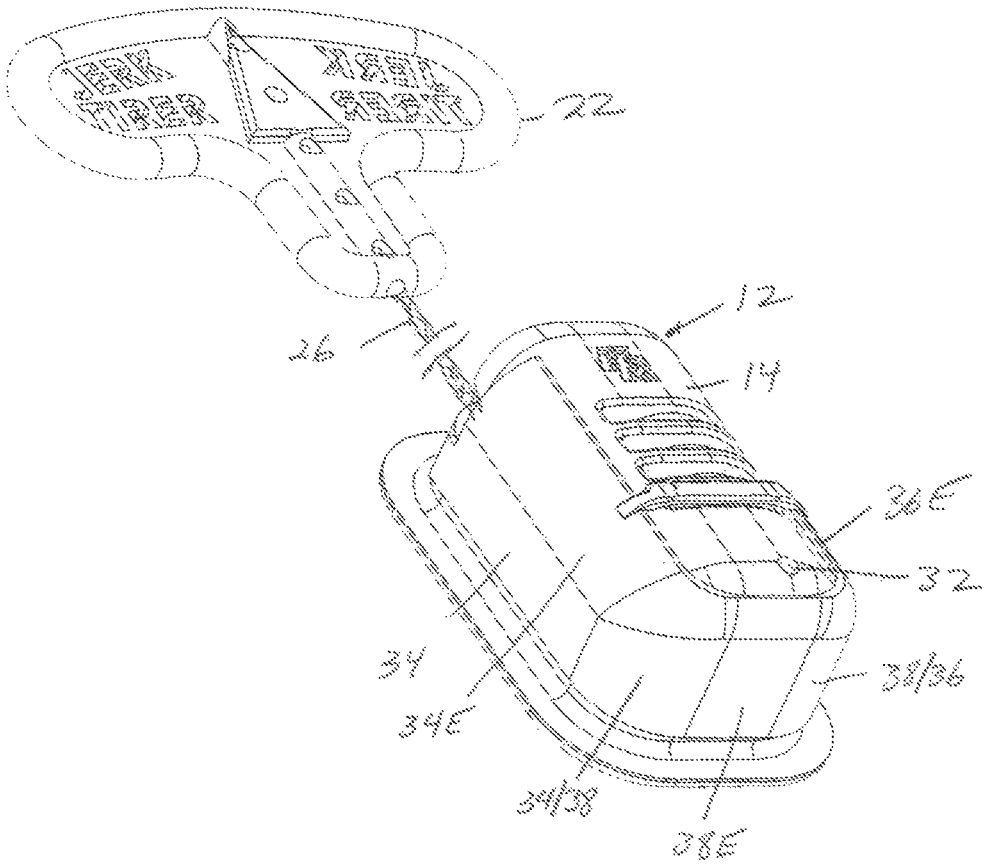
FIGS. 2A, 2B and 2C are bottom left perspective views showing (A) the indicator fitted onto the prior art inflator, (B) the prior art inflator without the indicator installed and (C) the indicator alone, not installed onto the prior art inflator.
Figure 2B:
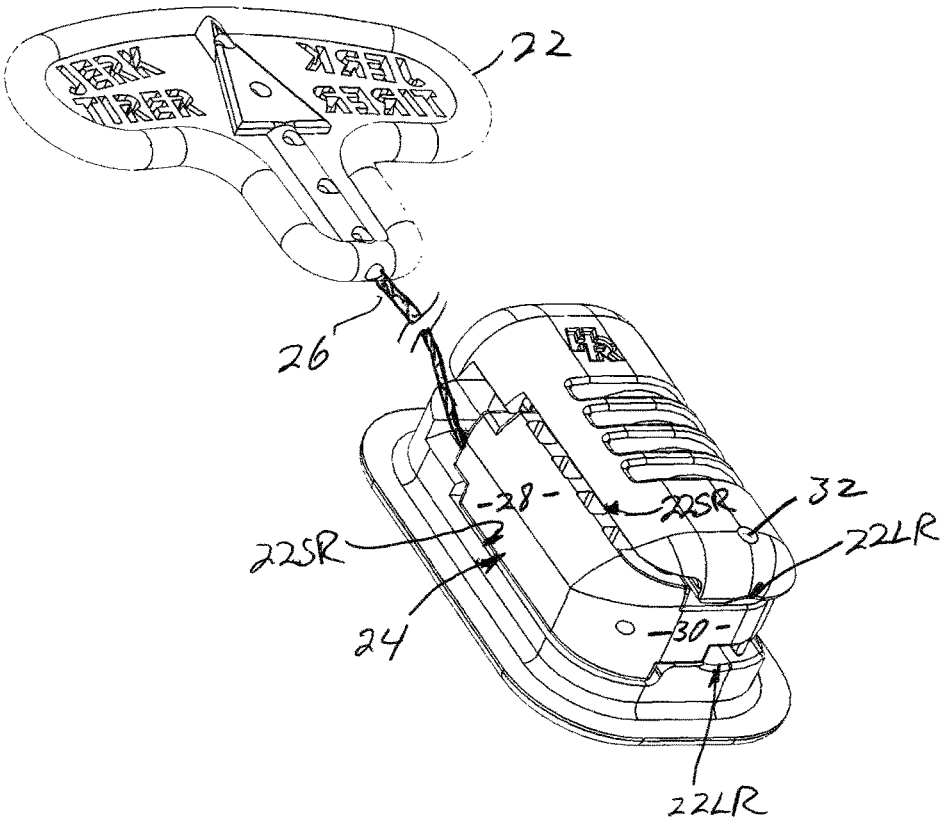
FIG. 2B PRIOR ART
Figure 2C:
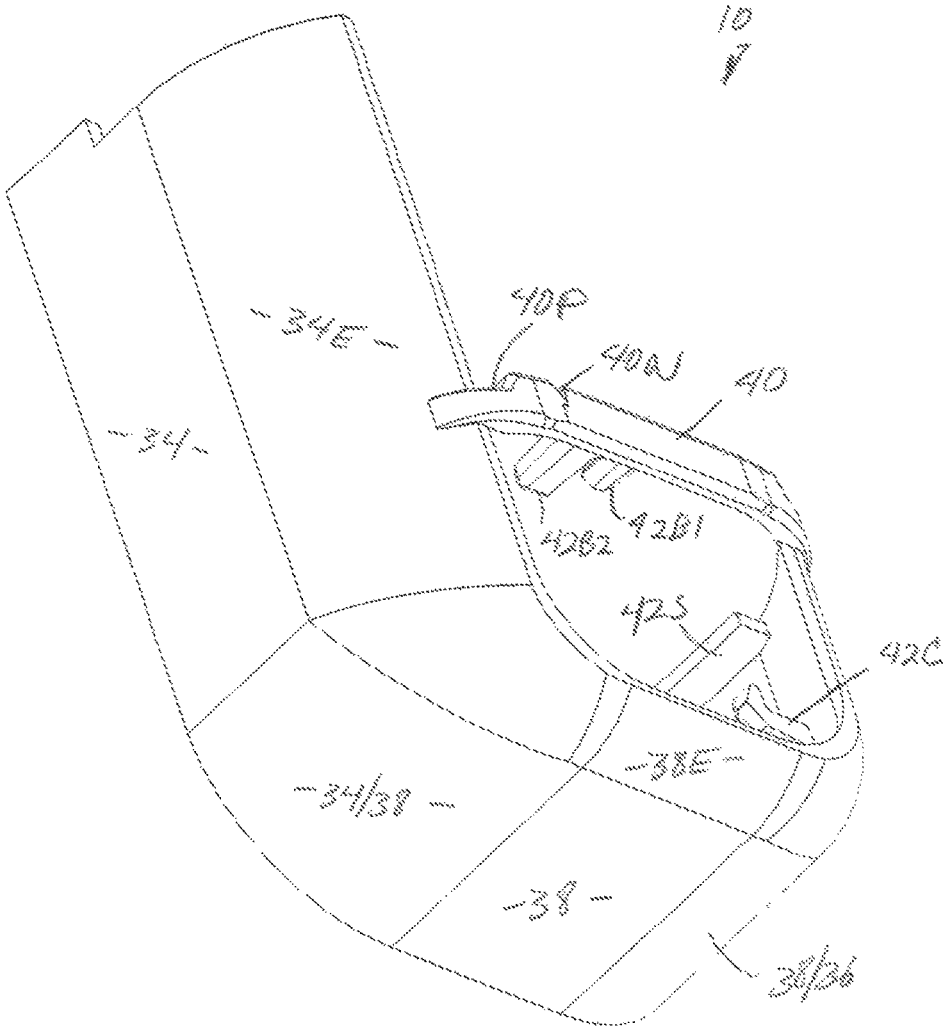

Firing of the inflator 12 is accomplished by means of a firing lever 22 (see FIG. 2B) to which is tethered a jerk handle 24 by means of a lanyard 26. The firing lever 22 comprises a generally L-shaped configuration having an upstanding arm 28 into which the lanyard 26 is inserted into and tightly and permanently secured such as by staking. The lower leg portion 30 of the firing lever 22 comprises a pivot hole through which a pivot pin 32 is inserted to allow the firing lever 22 to pivot about the pivot pin 32 upon jerking of the jerk handle 24. The lower leg portion 30 of the firing lever 22 includes a cam surface which is operatively designed to cam against a firing pin of an internal pierce pin assembly to fracture the frangible seal of the gas cartridge 18, whereupon gas from the gas cartridge 18 flows through the inflator 12 and out the exhaust port 20 into the article to be inflated.

The inflator's housing 14 may include an upstanding side recess 22SR and a lower side recess 22LR into which the upstanding arm 28 and lower leg portion 30 of the firing lever 22 respectively lays into so that the upstanding arm 28 and lower leg portion 30 are substantially flush with the corresponding side wall and bottom wall of the housing.

Turning now to a description of the indicator 10 of the invention as shown in FIGS. 1C, 2C and 4-11, indicator 10 comprises a generally rectangular configuration corresponding to the rectangular configuration of the housing 14. More particularly, indicator 10 comprises a generally U-shaped configuration defined by a long side wall 34 and a short side wall 36 joined together by a bottom wall 38 to form the U-shaped configuration. Preferably, the long side wall 34 is configured and dimensioned to fully cover and therefore conceal the upstanding arm 28 of the firing lever 22 of the inflator. Likewise, the bottom wall 38 of the indicator 10 is appropriately configured and dimensioned to cover and therefore conceal the lower leg portion 30 of the firing lever 22.

A corner wall 34/38 interconnects the bottom of the long side wall 34 and the left portion of bottom wall 38 and a corner wall 38/36 interconnects the right portion of the bottom wall 38 and short side wall 36. The front edges of the long side wall 34, bottom wall 38 and short side wall 36 may include respective arcuate edge walls 34E, 38E and 36E. Likewise, corner walls 34/38 and 38/36 may include respective arcuate edge walls 34/38E and 38/36E. The corner walls 34/38 and 38/36 coupled with the arcuate edge walls 34/38E, 38/36E, 34E, 38E and 36E more completely wrap around the corresponding rounded edges of the generally rectangular housing 14 of the inflator 12 to more completely conceal the firing lever 22 beneath. The side walls 34, 36 and 38 with their interconnecting corner walls 34/38 and 38/36 and arcuate edge walls 34/38E, 38/36E, 34E, 38E and 36E also more securely entrain the indicator 10 onto housing 14. It is noted that optionally, the side walls 34 and 36 of the indicator 10 may be injection-molded in a slightly contracted configuration to increase the degree that the side walls 34 and 36 must be spread apart to snap onto the corresponding side walls of the housing 14 and impart a greater grasping grip on the housing 14.

An optional bridge 40 composed of a thin material may be integrally formed during injection molding of the indicator 10 to span the distance between the edge walls 34E and 36E of the side walls 34 and 36. The bridge 40 more securely retains the side walls 34 and 36 about the corresponding side walls of the housing 14 of the inflator 12. The bridge 40 may be aligned with and extend into a corresponding slot 40S in the inflator's body, preferably substantially flush. During use, upon firing of the inflator 12, the firing lever 22 is pivoted outwardly about the pivot pin 32 and forcibly pops the bridge 40 out of the slot 40S as the indicator 10 is popped-off of the inflator housing 14.

Preferably, the bridge 40 is fracturable either by being composed of a thin material or by having a scored notch 40N formed partly therethrough such that the bridge 40 forcibly fractures at the notch 40N and potentially at a thin, weakened point 40P when the firing lever 22 is pivoted outwardly about the pivot pin 32 to pop the bridge 40 out of the slot 40S. The fractured bridge 40 of a previously-spent indicator 10 provides a visual indication not to re-use it. Even if reuse is attempted, the previously-spent indicator 10 cannot be installed unless the firing lever 22 is reset to its ready condition tucked into the recesses 22SR and 22LR of the housing 14.

The side walls 34 and 36 and the bridge 40 of the indicator 10 may be provided with integrally molded tabs 42 appropriately aligned and dimensioned to fit into corresponding pre-existing or specially-configured slots 44 in the inflator 12 to more securely retain the indicator 10 onto the housing 14.

Figure 10A:
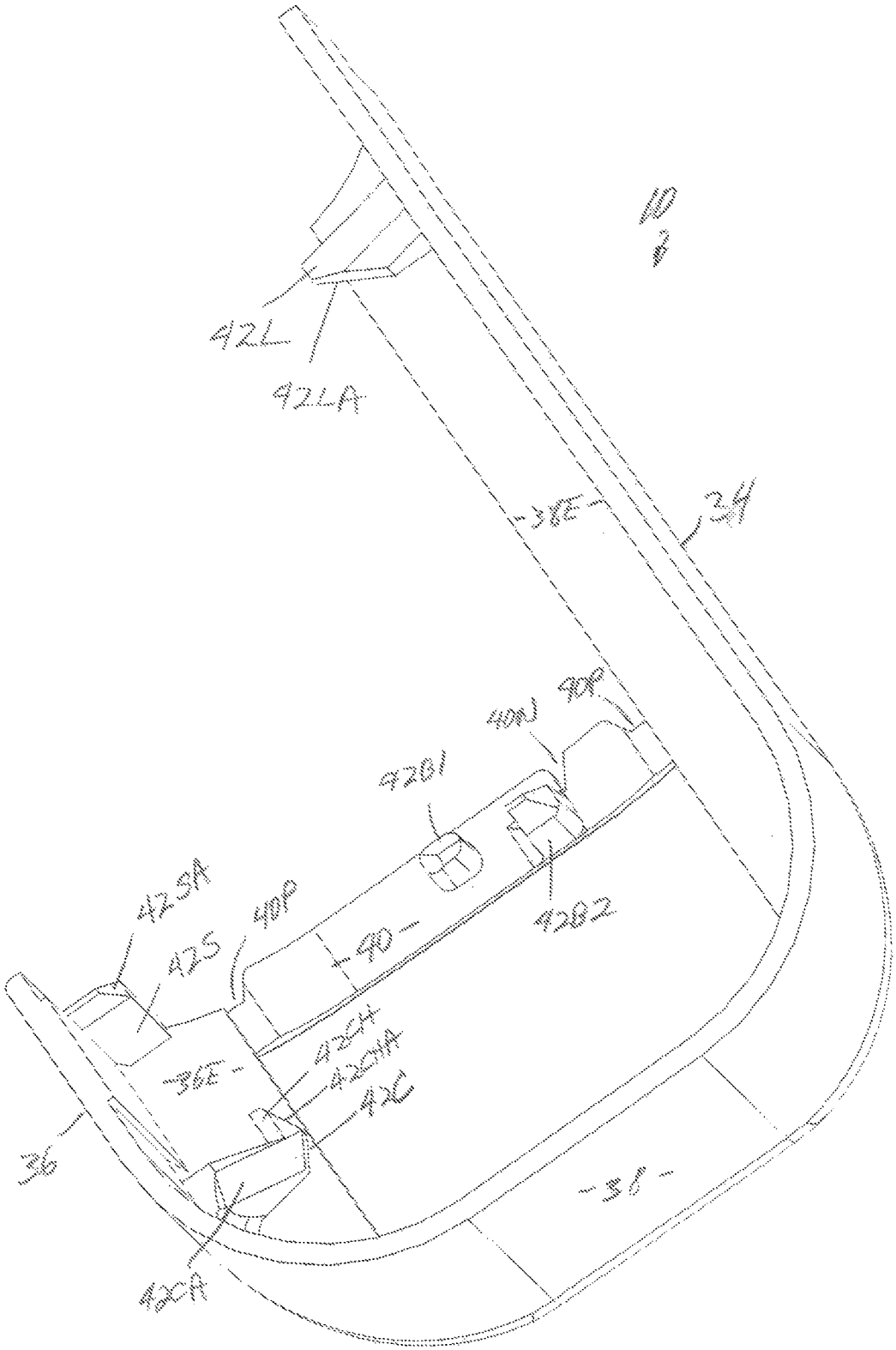
FIGS. 10A and 10B are rear perspective views of the indicator showing the tabs that more securely retains the indicator onto the inflator.
Figure 10B:
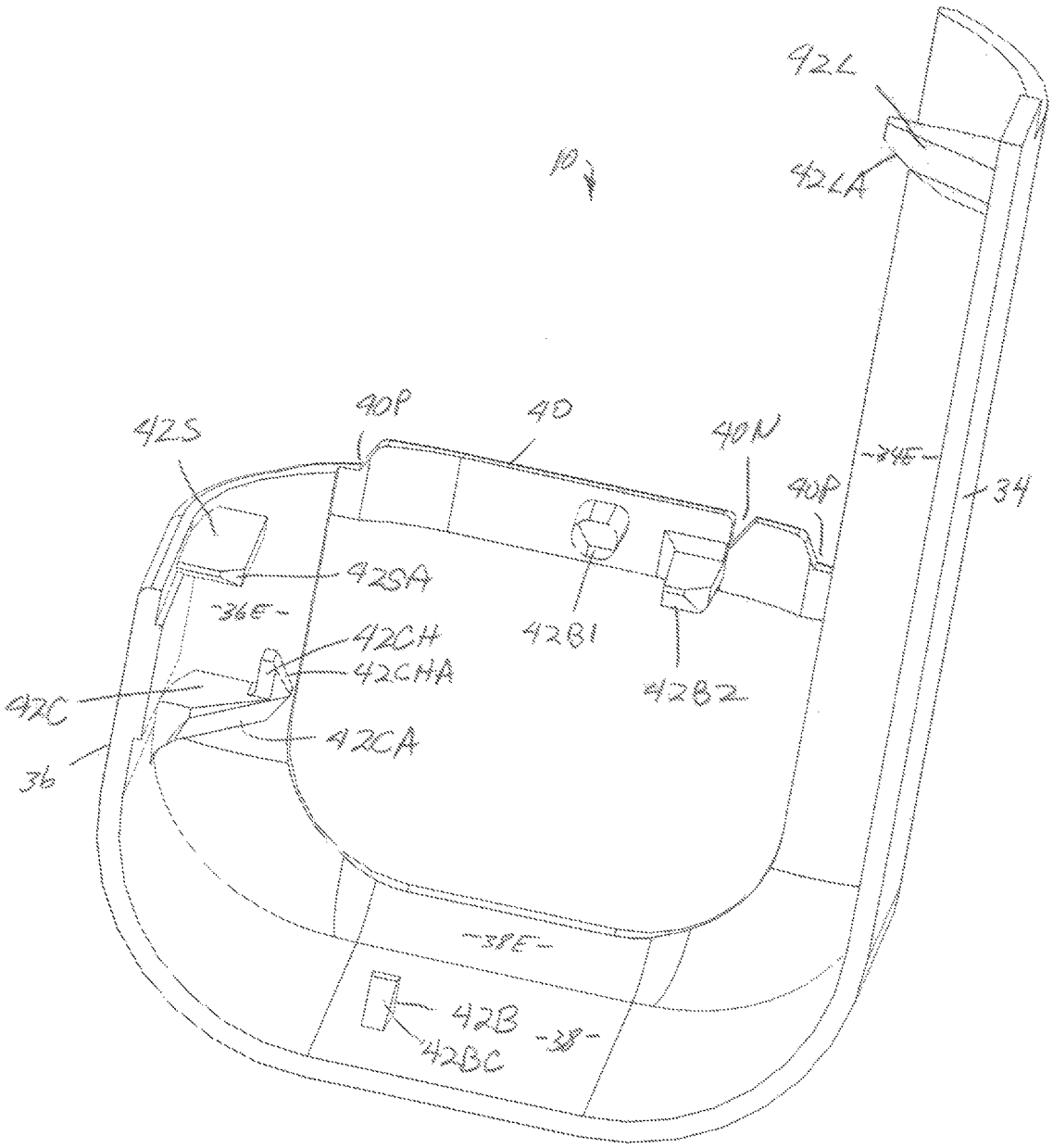
Figure 11:
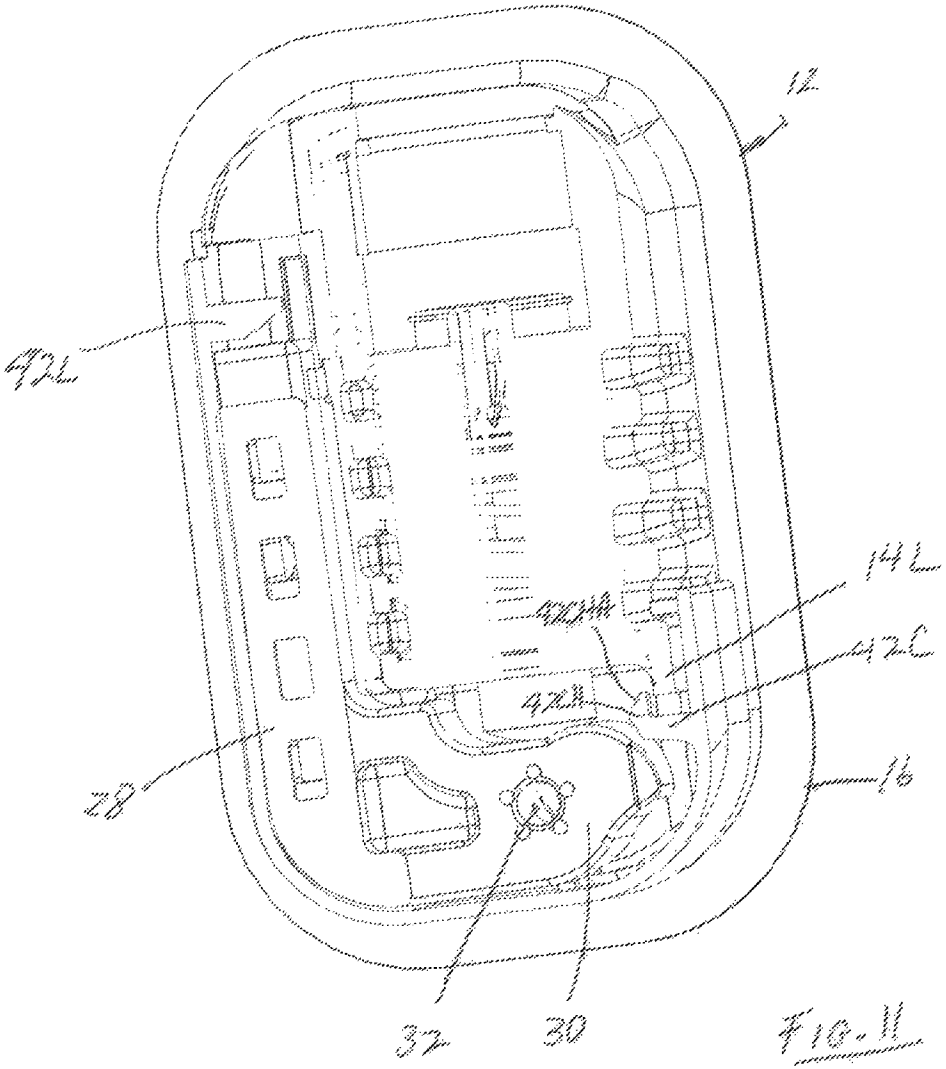
FIG. 11 is a cross-sectional view of the prior art inflator along lines 11-11 of FIG. 1A.

For example, as best shown in FIG. 10A, 10B and 11, a tab 42L on the long side wall 34 of the indicator 10 may include an inwardly-oriented tab 42L that fits into the recess 22SR between the upper end of the upstanding arm 28 of the firing lever 22. The tab 42L may be provided with an angle 42LA to facilitate insertion into the recess 22SR. Correspondingly, the short side wall 36 of the indicator 10 may include a inwardly-oriented tab 42S that is appropriately aligned and dimensioned to fit into a corresponding recess 14R formed in the side of the housing 14. Tab 42S likewise may include an angle 42SA to facilitate insertion into the recess 22LR. Also correspondingly, the bottom wall 38 of the indicator 10 may include a inwardly-oriented tab 42B that is appropriately aligned and dimensioned to fit between the lower leg portion 30 of the firing lever 22 into the lower side recess 22LR. Tab 42B likewise may include an angle 42BA to facilitate insertion into the recess 22LR.

Additional tabs may be provided such as tab 42C aligned with the corner of the housing 14 to fit into the space between the lower leg portion 30 of the firing lever 22 into the lower side recess 22LR at the point where the lower leg portion 30 begins to curve. The tab 42C may include an angle 42CA to facilitate insertion into the recess 22LR. The tab 42C many also include an upwardly extending hook 42CH, also with an angle 42CHA for ease in insertion, which hooks onto a lip 14L formed in the lower side recess 22LR.

Inwardly extending tabs 42B1 and 42B2 may be provided along the bridge 40 to fit into the slot 40S formed in the front surface of the housing 14 to facilitate centering within the slot 402 and to increase the ease in which the bridge 40 is fractured at the scored notch 40N.

It is noted that tabs 42 coupled with the inherent resiliency of the material constituting the indicator 10, increases the degree that the side walls 34 and 36 must be spread apart to snap onto the corresponding side walls of the housing 14, but then assures that the indicator 10 will be held into place more securely, that is until the side walls 34 and 36 are forced apart by the firing lever 22 upon firing of the inflator 12.

Preferably the firing lever 22 is colored red and the indicator 10 is colored green. When the green indicator 10 is snapped onto the housing 14 to fully cover and therefore conceal the red firing lever 22, the indicator 12 visually indicates from all directions an "armed" or "at ready" operable condition. Upon firing by jerking on the jerk handle 24 to pivot the firing lever 22, the bridge 40 is fractured and the indicator 10 is popped-off of the housing 14 of the inflator 12. While in this "unarmed" or "fired" condition, the red firing lever 22 visually indicates from all directions that the inflator 12 is inoperable.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. An indicator for fitting over an inflator, the inflator including an upstanding arm of a firing lever and a lower leg portion of the firing lever, said indicator comprising a long side wall and a short side wall joined together by a bottom wall to form a generally U-shaped configuration, said long side wall being configured and dimensioned to cover and conceal an upstanding arm of the firing lever of the inflator and said bottom wall being configured and dimensioned to cover and conceal the lower leg portion of the firing lever.

2. The indicator for an inflator as set forth in claim 1, further including a corner wall interconnecting a bottom of said long side wall and a left portion of said bottom wall and a corner wall interconnecting a right portion of said bottom wall and said short side wall.

3. The indicator for an inflator as set forth in claim 2, wherein front edges of said long side wall, said bottom wall and said short side wall include respective arcuate edge walls to configured and dimensioned to more completely wraparound the inflator and to more securely entrain the indicator onto the inflator.

4. The indicator for an inflator as set forth in claim 2, wherein said side walls are injection-molded in a slightly contracted configuration to increase the degree that said side walls must be spread apart to snap onto the inflator and impart a greater grasping grip on the inflator.

5. The indicator for an inflator as set forth in claim 1, further including a bridge to span a distance between said side walls.

6. The indicator for an inflator as set forth in claim 1, further including at least one tab that fits into a corresponding slot in the inflator to more securely retain the indicator onto the inflator.

7. The indicator for an inflator as set forth in claim 6, wherein said tab is positioned on said the long side wall.

8. The indicator for an inflator as set forth in claim 6, wherein said tab is positioned on said short side wall.

9. The indicator for an inflator as set forth in claim 6, wherein said tab is positioned on said bottom wall.

10. The indicator for an inflator as set forth in claim 6, wherein said tab is positioned on a corner of said bottom wall and includes a hook that hooks onto a lip formed in the lower side recess.

11. The indicator for an inflator as set forth in claim 6, wherein said tab comprises an angle to facilitate insertion.

12. The indicator for an inflator as set forth in claim 1, wherein the firing lever is colored red and said indicator is colored green such that when said green indicator is snapped onto the inflator to cover and conceal the red firing lever, said indicator visually indicates from all directions an "armed" or "at ready" operable condition and such that upon firing of the inflator said indicator is popped-off of the inflator revealing an "unarmed" or "fired" condition.

13. An indicator for an inflator comprising in combination a long side wall and a short side wall joined together by a bottom wall to form a generally U-shaped configuration, said long side wall being configured and dimensioned to cover and conceal an upstanding arm of a firing lever of the inflator and said bottom wall being configured and dimensioned to cover and conceal a lower leg portion of the firing lever, and further including a bridge to span a distance between said side walls, wherein said bridge is composed of a thin material that fractures when the firing lever is moved to its fired position.

14. An indicator for an inflator comprising in combination a long side wall and a short side wall joined together by a bottom wall to form a generally U-shaped configuration, said long side wall being configured and dimensioned to cover and conceal an upstanding arm of a firing lever of the inflator and said bottom wall being configured and dimensioned to cover and conceal a lower leg portion of the firing lever, and further including a bridge to span a distance between said side walls, wherein said bridge is integrally formed during injection molding of the indicator.

15. An indicator for an inflator comprising in combination a long side wall and a short side wall joined together by a bottom wall to form a generally U-shaped configuration, said long side wall being configured and dimensioned to cover and conceal an upstanding arm of a firing lever of the inflator and said bottom wall being configured and dimensioned to cover and conceal a lower leg portion of the firing lever, and further including a bridge to span a distance between said side walls, wherein said bridge is aligned with and extends into a corresponding slot in the inflator.

16. An indicator for an inflator comprising in combination a long side wall and a short side wall joined together by a bottom wall to form a generally U-shaped configuration, said long side wall being configured and dimensioned to cover and conceal an upstanding arm of a firing lever of the inflator and said bottom wall being configured and dimensioned to cover and conceal a lower leg portion of the firing lever, and further including a bridge to span a distance between said side walls, wherein said bridge comprises a scored notch formed partly therethrough such that said bridge forcibly fractures at said notch when the firing lever is pivoted outwardly to pop said bridge out of the slot.

17. An indicator for an inflator comprising in combination a long side wall and a short side wall joined together by a bottom wall to form a generally U-shaped configuration, said long side wall being configured and dimensioned to cover and conceal an upstanding arm of a firing lever of the inflator and said bottom wall being configured and dimensioned to cover and conceal a lower leg portion of the firing lever, and further including a bridge to span a distance between said side walls, wherein said bridge comprises a inwardly extending tab to fit into the slot to facilitate centering within the slot and to increase the ease in which said said bridge is fractured.

* * * * *